US012292228B2

(12) United States Patent
Lyu et al.

(10) Patent No.: US 12,292,228 B2
(45) Date of Patent: May 6, 2025

(54) REFRIGERATOR

(71) Applicants: QINGDAO HAIER REFRIGERATOR CO., LTD., Shandong (CN); HAIER SMART HOME CO., LTD., Shandong (CN)

(72) Inventors: Peng Lyu, Qingdao (CN); Jiaming Li, Qingdao (CN); Zhanpeng Cui, Qingdao (CN); Hao Zhang, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 105 days.

(21) Appl. No.: 18/245,366

(22) PCT Filed: Sep. 7, 2021

(86) PCT No.: PCT/CN2021/116934
§ 371 (c)(1),
(2) Date: Mar. 15, 2023

(87) PCT Pub. No.: WO2022/057683
PCT Pub. Date: Mar. 24, 2022

(65) Prior Publication Data

US 2023/0332824 A1 Oct. 19, 2023

(30) Foreign Application Priority Data

Sep. 15, 2020 (CN) ..... 202010970815.8

(51) Int. Cl.
*F25D 23/02* (2006.01)
*F25D 23/12* (2006.01)

(52) U.S. Cl.
CPC ..... *F25D 23/028* (2013.01); *F25D 23/12* (2013.01); *F25D 2323/023* (2013.01)

(58) Field of Classification Search
CPC ..... F25D 21/04; F25D 23/12; F25D 23/028; F25D 2323/023
See application file for complete search history.

(56) References Cited

U.S. PATENT DOCUMENTS 2,745,259 A * 5/1956 Saunders ..... F25D 23/025 62/518
6,059,420 A * 5/2000 Rogers ..... F25D 27/00 362/802

(Continued)

FOREIGN PATENT DOCUMENTS

CN 102519204 A 6/2012
CN 102519204 B 8/2014

(Continued)

OTHER PUBLICATIONS

International Search Report and Written Opinion for PCT/CN2021/116934 (ISA/CN) mailed Dec. 8, 2021 w/English translation (13 pages).

(Continued)

*Primary Examiner* — James O Hansen
(74) *Attorney, Agent, or Firm* — ALSTON & BIRD LLP

(57) ABSTRACT

A refrigerator, comprising: a refrigerator body having an open front side to define a first compartment; a primary door mounted to the refrigerator body and used for opening/closing the first compartment, the primary door defining a second compartment having an open front side; and a secondary door mounted to the primary door and used for opening/closing the second compartment, the secondary door comprising a state adjustable door panel, and the state adjustable door panel being configured to controllably change transparency such that the visibility of an internal (Continued)

structure of the second compartment is adjustable. According to the refrigerator of the present invention, the frequency of opening the secondary door can be effectively reduced, the product high-tech element is added, and the user experience is improved.

10 Claims, 6 Drawing Sheets

(56) References Cited

U.S. PATENT DOCUMENTS

| | | | | |
|---|---|---|---|---|
| 9,829,241 | B2 | 11/2017 | Seo et al. | |
| 10,386,115 | B2 | 8/2019 | Seo et al. | |
| 10,578,352 | B2 | 3/2020 | Kim | |
| 2011/0134627 | A1 | 6/2011 | Hamlin et al. | |
| 2015/0276302 | A1* | 10/2015 | Roh | G02F 1/133377 62/127 |
| 2015/0338715 | A1* | 11/2015 | Schaefer | F25D 1/00 362/311.01 |
| 2017/0234603 | A1* | 8/2017 | Basso | F25D 23/04 454/183 |

FOREIGN PATENT DOCUMENTS

| | | | |
|---|---|---|---|
| CN | 105143798 | A | 12/2015 |
| CN | 105444489 | A | 3/2016 |
| CN | 107084572 | A | 8/2017 |
| CN | 108344230 | A | 7/2018 |
| CN | 209893762 | U | 1/2020 |
| CN | 111219927 | A | 6/2020 |
| CN | 213514587 | U | 6/2021 |
| KR | 20040105177 | A | 12/2004 |
| KR | 2019-0137477 | A | 12/2019 |
| WO | WO 2004/059228 | A1 | 7/2004 |

OTHER PUBLICATIONS

Supplementary European Search Report for European Patent Application No. 21868508.9 dated May 7, 2024 (6 pages).
1$^{ST}$ Office Action for European Patent Application No. 21868508.9 dated May 21, 2024 (7 pages).
Supplementary Partial European Search Report for European Patent Application No. 21868508.9 dated Jan. 17, 2024 (12 pages).
First Office Action for China Patent Application No. 202010970815.8 dated Dec. 20, 2024.

* cited by examiner

REFRIGERATOR

CROSS-REFERENCE TO RELATED APPLICATIONS

The present application is a national phase entry of International Application No. PCT/CN2021/116934, filed Sep. 7, 2021, which claims priority to Chinese Application No. 202010970815.8, filed Sep. 15, 2020, which are each incorporated herein by reference in its entirety.

FIELD OF THE INVENTION

The present invention relates to the field of refrigerating and freezing technologies, and particularly to a refrigerator.

BACKGROUND OF THE INVENTION

With the technical progress and the improvement of the living standard of people, requirements of users for refrigerators are higher and higher. A traditional refrigerator having only a refrigerating chamber, a freezing chamber and a variable temperature chamber fails to meet the demand of the users for diversification of a storage space.

In recent years, a composite door technology appears in the field of refrigerators. As is well known, a traditional refrigerator door is used for opening and closing a refrigerating compartment of a refrigerator body, and at most, a bottle holder is provided at a liner of a refrigerating door for holding a bottled object. The refrigerator with the composite door improves the structure and the function of the door, such that the door includes a primary door and a secondary door, and the primary door is used for opening and closing the refrigerating compartment. The primary door defines a door compartment having an open front side, and the secondary door is used for opening and closing the door compartment. In a rotation process of the primary door, the secondary door is kept in a closed state. The door compartment can be used for placing storage objects, only the secondary door is required to be opened when the storage objects are taken and placed, without opening the primary door.

The composite door structure of the refrigerator facilitates classified storage of the storage objects and door opening and closing operations of a user, but an actual product still has some problems; for example, the secondary door is opened too frequently, such that the cold loss of the door compartment is large; inner walls of the door compartment are prone to condensation, and these problems hinder a further development of the composite door technology.

BRIEF DESCRIPTION OF THE INVENTION

An object of the present invention is to overcome at least one of the above-mentioned drawbacks of the prior art and provide a refrigerator which can effectively reduce the frequency of opening a secondary door.

Another object of the present invention is to add the product high-tech element and improve the user experience.

Still another object of the present invention is to reduce condensation on the inner wall of a second compartment of the refrigerator.

In particular, the present invention provides a secondary door for a refrigerator, including:

a refrigerator body having an open front side to define a first compartment;

a primary door mounted to the refrigerator body and used for opening/closing the first compartment, the primary door defining a second compartment having an open front side; and a secondary door mounted to the primary door and used for opening/closing the second compartment, the secondary door comprising a state adjustable door panel, and the state adjustable door panel being configured to controllably change transparency such that the visibility of an internal structure of the second compartment is adjustable.

Optionally, the state adjustable door panel is configured to be in a transparent state when a human body exists within a preset distance from the front side of the secondary door, and in a non-transparent state when no human body exists in the preset distance from the front side of the secondary door.

Optionally, the second compartment is divided into a plurality of storage regions; the state adjustable door panel includes a plurality of adjusting subregions with independently adjustable transparency, and the adjusting subregions are opposite to the plural storage regions respectively; the state adjustable door panel is configured to switch each adjusting subregion from the non-transparent state to the transparent state when the adjusting subregion is pressed, such that the corresponding storage region is in a visible state.

Optionally, the state adjustable door panel includes a first glass layer, a second glass layer, and a liquid crystal layer therebetween, and the liquid crystal layer is configured to be in a transparent state when in a powered-on state and in a non-transparent state when in a powered-off state.

Optionally, a rear wall of the primary door is provided with an air supply port and a return air port which are communicated with the first compartment and the second compartment; the rear wall is hollow, a condensation removing air duct communicated with the first compartment is defined in the rear wall, and a plurality of condensation removing holes communicated with the second compartment and the condensation removing air duct are formed in the front surface of the rear wall backwards; the refrigerator is configured to: be in a cooling cycle mode where air in the first compartment enters the second compartment through the air supply port and then returns to the first compartment through the return air port; or in a condensation removing mode where the air in the first compartment enters the condensation removing air duct, so as to allow part of the air flow to flow to the front surface of the rear wall through the condensation removing holes to remove surface condensation of the rear wall.

Optionally, the condensation removing air duct has an inlet and an outlet communicated with the first compartment; the refrigerator is configured to allow the inlet and the outlet to be in a closed state and an open state respectively when in the cooling cycle mode, and to allow both the inlet and the outlet to be in the open state when in the condensation removing mode.

Optionally, the inlet penetrates through a sidewall of the air supply port to be communicated with the air supply port, and the outlet penetrates through a sidewall of the return air port to be communicated with the return air port.

Optionally, the refrigerator further includes a damper mounted at the air supply port and configured to be controllably moved to a cooling state where the inlet is closed and the air supply port is opened, or to a condensation removing state where the inlet is opened and the air supply port is closed.

Optionally, one end of the damper is rotatably mounted at a front edge of the inlet to rotate to the cooling state or the condensation removing state.

Optionally, the arrangement density of the condensation removing holes is gradually decreased in a direction from the air supply port to the return air port.

In the refrigerator according to the present invention, the secondary door includes the state adjustable door panel, and the transparency of the state adjustable door panel is adjustable, such that the visibility of the internal structure of the second compartment is adjustable. Therefore, when a user needs to know the storage condition of the second compartment, the state adjustable door panel of the refrigerator can be in the transparent state. After observing the storage condition of the second compartment, the user does not open the secondary door if unnecessary, thus avoiding that cold leakage is caused when the secondary door is opened, and also avoiding that due to external air entering the second compartment, the temperature and humidity of the second compartment change to increase a risk of condensation of the inner wall of the second compartment. Furthermore, the transparency of the secondary door is adjustable, such that the overall high-tech element of the refrigerator is full, and the product grade and the user experience are improved.

Further, in the refrigerator according to the present invention, when no human body exists in the preset distance from the front side of the secondary door, the state adjustable door panel is in the non-transparent state, such that the internal structure of the second compartment is invisible to avoid influences of the internal structure on the appearance of the refrigerator. When a human body exists in the preset distance from the front side of the secondary door, the refrigerator presumes that the user has the possibility of opening the door, and the state adjustable door panel is switched to the transparent state, such that the internal structure of the second compartment is visible, and the storage condition thereof is shown to the user, so as to avoid an unnecessary door opening operation. Therefore, with the refrigerator according to the present invention, the storage condition of the second compartment can be obtained without opening the secondary door, and the appearance of the refrigerator is prevented from being adversely affected.

Further, in the refrigerator according to the present invention, the structure of the state adjustable door panel is further refined, such that the state adjustable door panel includes the plurality of adjusting subregions with the independently adjustable transparency, the adjusting subregions are opposite to the plurality of storage regions of the second compartment respectively, and when each adjusting subregion is pressed, the adjusting subregion is switched from the non-transparent state to the transparent state, such that the corresponding storage region is in a visible state. Therefore, the transparency of the state adjustable door panel can be directly and manually switched by the user, and the plurality of adjusting subregions are divided for the user to select, thus improving the operation experience of the user.

Further, in the present invention, the condensation on the inner wall of the second compartment can be effectively removed by specially designing the primary door. Specifically, in the present invention, the rear wall of the primary door is hollow to define the condensation removing air duct, and the front surface of the rear wall is backwards provided with the plurality of condensation removing holes. When the second compartment is required to be refrigerated normally, the refrigerator operates in the cooling cycle mode, such that the air in the first compartment normally enters the second compartment through the air supply port, so as to refrigerate the second compartment. When condensation is generated on the rear wall surface of the second compartment (i.e., the front surface of the rear wall of the primary door) and required to be removed, the refrigerator operates in the condensation removing mode, such that the air in the first compartment enters the condensation removing air duct in the rear wall of the primary door, so as to allow part of the air flow to flow to the front surface of the rear wall through the condensation removing holes. The relative humidity of the air in the condensation removing air duct is certainly lower than that of the original air flow at the front surface of the rear wall of the primary door (the relative humidity of the air near the condensation is certainly high), and therefore, introduction of the low-humidity air in the condensation removing air duct can promote evaporation of the condensation.

In addition, when the refrigerator according to the present invention operates in the condensation removing mode, the traditional modes of electrically heating the rear wall or introducing hot air, or the like, are not adopted, and condensation removal is carried out utilizing the cold air of the first compartment, such that the normal refrigeration of the second compartment is basically not influenced in the condensation removing process, and the structural design is ingenious.

According to the following detailed description of specific embodiments of the present invention in conjunction with drawings, those skilled in the art will better understand the aforementioned and other objects, advantages and features of the present invention.

BRIEF DESCRIPTION OF THE DRAWINGS

Some specific embodiments of the present invention will be described below in detail in an exemplary rather than restrictive manner with reference to the drawings. Identical reference numerals in the drawings represent identical or similar components or parts. Those skilled in the art should understand that these drawings are not necessarily drawn to scale. In the drawings.

DETAILED DESCRIPTION

Figure 1:
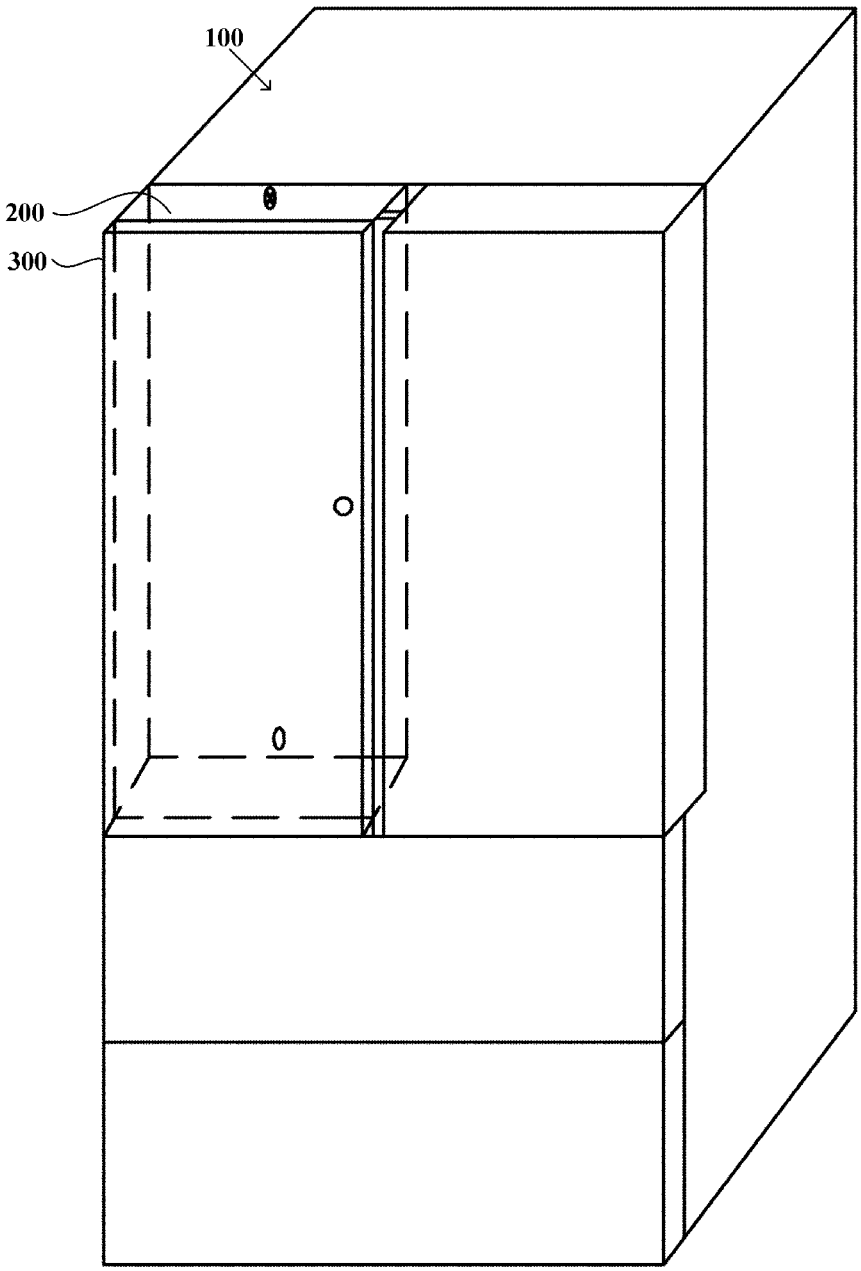
FIG. 1 is a schematic principle diagram of a refrigerator according to an embodiment of the present invention.

A refrigerator according to an embodiment of the present invention is described below with reference to FIGS. 1 to 8. Directions or positional relationships indicated by terms "front", "rear", "upper", "lower", "top", "bottom", "inner", "outer", "transverse" etc. are based on orientations or positional relationships shown in the drawings, and they are used only for describing the present invention and for description simplicity, but do not indicate or imply that an indicated device or element must have a specific orientation or be constructed and operated in a specific orientation. Therefore, it cannot be understood as a limitation on the present invention.

Figure 2:
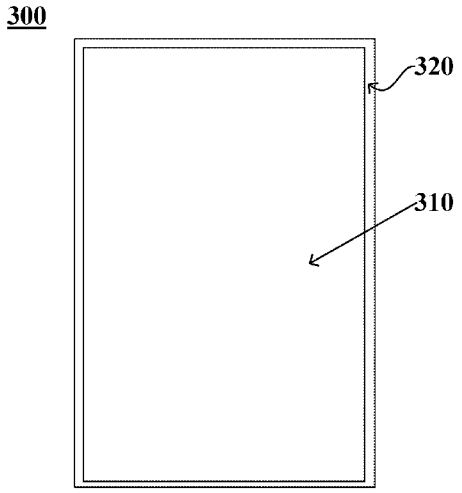
FIG. 2 is a schematic structural diagram of a secondary door in an embodiment of the present invention.
Figure 3:
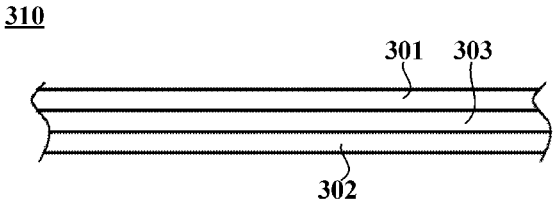
FIG. 3 is a schematic sectional diagram of a state adjustable door panel in an embodiment of the present invention.
Figure 4:
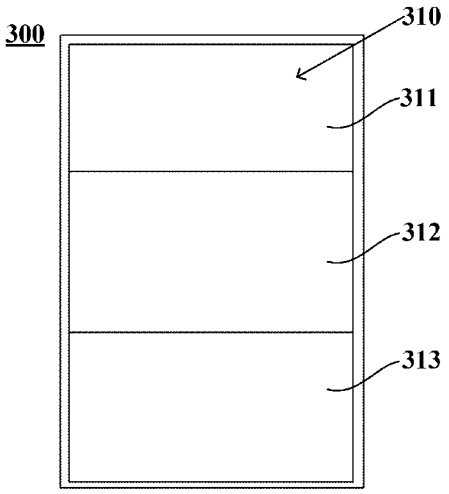
FIG. 4 is a schematic structural diagram of a secondary door in another embodiment of the present invention.
Figure 5:
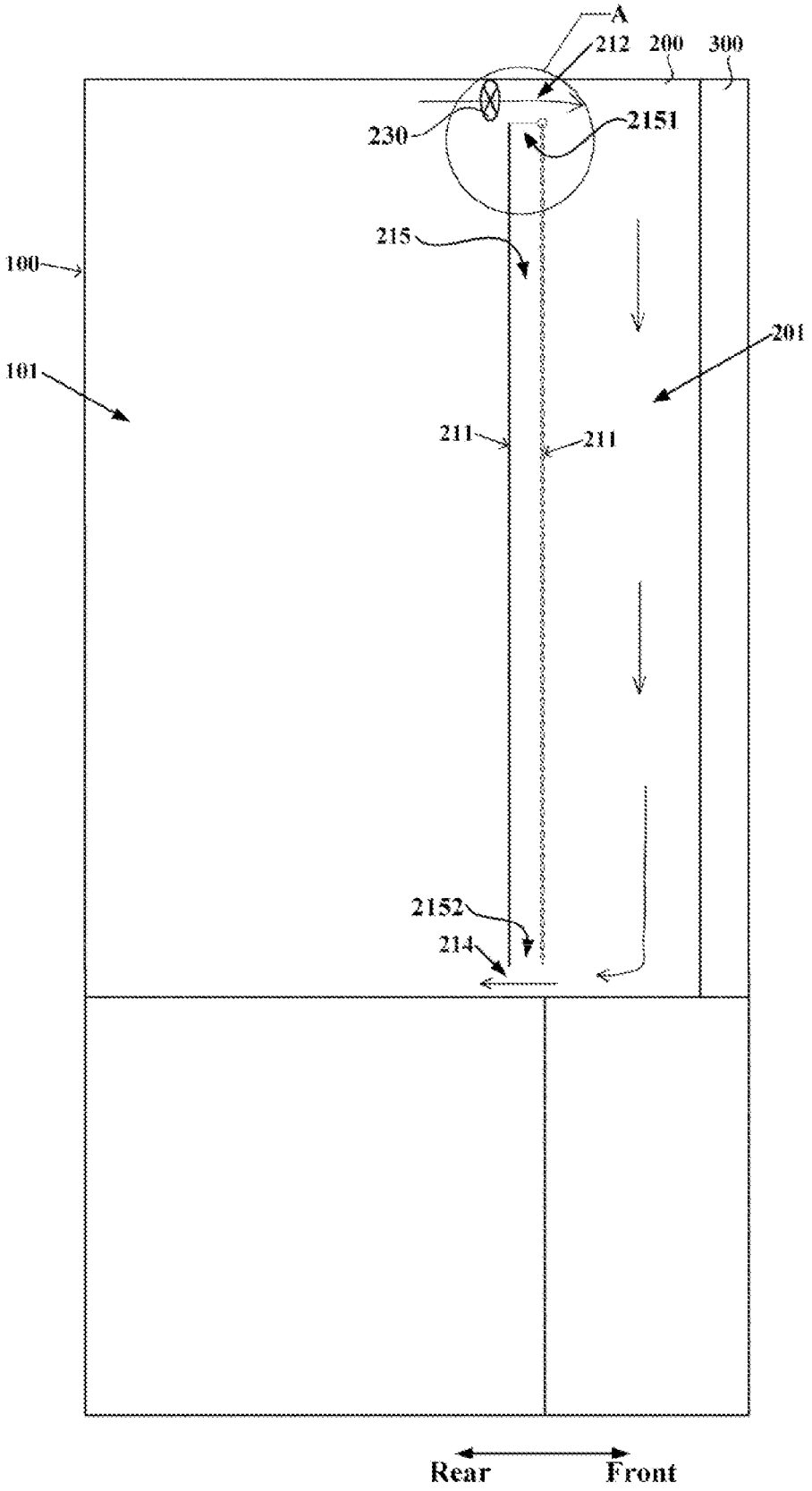
FIG. 5 is a schematic diagram of a refrigerator in a cooling cycle mode according to an embodiment of the present invention.

FIG. 1 is a schematic principle diagram of a refrigerator according to an embodiment of the present invention; FIG. 2 is a schematic structural diagram of a secondary door in an embodiment of the present invention; FIG. 3 is a schematic sectional diagram of a state adjustable door panel in an embodiment of the present invention; FIG. 4 is a schematic structural diagram of a secondary door in another embodiment of the present invention; and FIG. 5 is a schematic diagram of a refrigerator in a cooling cycle mode according to an embodiment of the present invention.

As shown in FIGS. 1 to 5, the refrigerator according to the embodiment of the present invention may generally include a refrigerator body 100, a primary door 200 and a secondary door 300. The refrigerator body 100 has an open front side to define a first compartment 101. The primary door 200 is mounted to the refrigerator body 100 and used for opening/closing the first compartment 101, and the primary door 200 defines a second compartment 201 having an open front side. The secondary door 300 is mounted to the primary door 200 and used for opening/closing the second compartment 201.

The inventor finds that, since a user has difficulty in clearly memorizing specific storage positions of storage objects in the refrigerator, the user tends to open doors one by one when the user wants to take out some storage objects. The refrigerator with a composite door structure is additionally provided with the secondary door 300 outside the primary door 200, such that storage positions of the refrigerator are more, doors are more, and total door opening times are further increased, thus causing serious cold loss and other problems. In the embodiment of the present invention, as shown in FIG. 2, the secondary door 300 includes a state adjustable door panel 310. The state adjustable door panel 310 may be mounted on a door frame 320, and the door frame 320 is used for being mounted to the primary door 200. The state adjustable door panel 310 is configured to controllably change transparency thereof, such that the visibility of an internal structure of the second compartment 201 is adjustable. Therefore, when the user needs to know the storage object stored in the second compartment 201, the state adjustable door panel 310 of the refrigerator can be made to be in a transparent state. After observing the storage condition of the second compartment 201, the user does not open the secondary door 300 if unnecessary, thus avoiding that cold leakage is caused when the secondary door 300 is opened, and also avoiding that due to external air entering the second compartment 201, the temperature and humidity of the second compartment change to increase a risk of condensation of the inner wall of the second compartment 201. The transparency of the secondary door 300 is adjustable, such that the overall high-tech element of the refrigerator is full, and the product grade and the user experience are improved.

In some embodiments, transparency adjustment of the state adjustable door panel 310 includes adjustment to a transparent state and a non-transparent state. As shown in FIG. 3, the state adjustable door panel 310 includes a first glass layer 301, a second glass layer 302, and a liquid crystal layer 303 therebetween, and the liquid crystal layer 303 is configured to be in a transparent state when in a powered-on state and in a non-transparent state when in a powered-off state. The liquid crystal layer 303 includes polymer dispersed liquid crystals (PDLCs) formed by dispersing small droplets of liquid crystals in the order of micrometers in an organic solid polymer matrix, and since the optical axes of the small droplets formed by liquid crystal molecules are in a free orientation, the refractive index thereof is not matched with that of the matrix, and light is strongly scattered by the droplets when passing through the matrix, such that an opaque milky white state or a translucent state is shown. Application of an electric field can adjust the orientation of the optical axes of the liquid crystal droplets, and when the refractive indexes are matched with each other, the overall liquid crystal layer 303 assumes a transparent state. After the electric field is removed, the liquid crystal droplets restore the original light scattering state, such that the overall liquid crystal layer 303 assumes a non-transparent state.

In some alternative embodiments, the transparency adjustment of the state adjustable door panel 310 may also include adjustment to a transparent state, a non-transparent state, and a translucent state.

In some embodiments, the state adjustable door panel 310 is configured to be in a transparent state when a human body exists within a preset distance from the front side of the secondary door 300. The state adjustable door panel is configured to be in a non-transparent state when no human body exists in the preset distance from the front side of the secondary door 300. Specifically, the refrigerator may include a controller and an infrared sensor, the infrared sensor senses the human body, and the controller receives a sensing signal of the infrared sensor and controls switching of the state of the state adjustable door panel 310.

When the refrigerator is in a normal operation state, that is, when there is no human body within the preset distance from the front side of the secondary door 300, the internal structure of the second compartment 201 is invisible to prevent the internal structure from affecting the appearance of the refrigerator. When a human body exists in the preset distance from the front side of the secondary door 300, the refrigerator presumes that the user has the possibility of opening the door, and the state adjustable door panel 310 is switched to the transparent state, such that the internal structure of the second compartment 201 is visible, and the storage condition thereof is shown to the user, so as to avoid an unnecessary door opening operation. According to a general operation habit, when the user is within 1 m or less from the front side of the refrigerator, the possibility of opening the door is high, and thus, the preset distance may be set to a value less than 1 m. Thus, with the refrigerator according to the present invention, the storage condition of the second compartment 201 can be obtained without opening the secondary door 300, and the appearance of the refrigerator is prevented from being adversely affected.

In other embodiments, as shown in FIG. 4, the second compartment 201 may be divided into a plurality of storage regions; for example, a plurality of shelves may be provided, and the space above each shelf forms one storage region. The state adjustable door panel 310 includes a plurality of adjusting subregions 311, 312, 313 with independently adjustable transparency. The plurality of adjusting subregions 311, 312, 313 face the plurality of storage regions respectively. The state adjustable door panel is configured to switch each adjusting subregion from the non-transparent state to the transparent state when the adjusting subregion is pressed, such that the corresponding storage region is in a visible state. Thus, the user can selectively observe the storage condition of some storage regions of the second compartment. The transparency switching of the state adjustable door panel 310 is operated by the user, thereby improving the operation experience of the user.

In some embodiments, the primary door 200 may be rotatably mounted to the refrigerator body 100 at the front side of the refrigerator body 100, the primary door 200 has an open front side to define the aforementioned second compartment 201, and the secondary door 300 may be rotatably mounted to the primary door 200 at the front side of the primary door 200. When the primary door 200 is opened, the user can access items from the first compartment 101. When the primary door 200 is closed and the secondary door 300 is opened, the user can access items from the second compartment 201.

The refrigerator may be refrigerated by a vapor compression refrigeration cycle system, a semiconductor refrigeration system, or other means. Compartments inside the refrigerator may include a refrigerating chamber, a freezing chamber, and a variable temperature chamber according to a refrigerating temperature. For example, the temperature in the refrigerating chamber is generally controlled between 2° C. and 10° C., preferably between 4° C. and 7° C. The temperature range in the freezing chamber is generally controlled between −22° C. and −14° C. The variable temperature chamber can be adjusted between −18° C. and 8° C. to achieve a variable temperature effect. The optimal storage temperatures of different kinds of items are different, and the storage compartments suitable for storage are also different. For example, fruit and vegetable foods are suitable for being stored in the refrigerating chamber, while meat foods are suitable for being stored in the freezing chamber. The first compartment 101 in the embodiment of the present invention is preferably the refrigerator chamber.

In the existing refrigerator with a composite door, the condensation problem of the inner wall of a compartment defined by the door is serious. The inventor recognizes that since a rear wall 211 of the primary door 200 is close to the first compartment 101 and can exchange heat with the air in the first compartment 101 by heat conduction, the temperature of the front surface of the rear wall 211 is lower than that of other wall surfaces of the second compartment 201, and condensation is more likely to occur thereon.

Based on the above recognition, in the embodiment of the present invention, the condensation on the front surface of the rear wall 211 of the second compartment 201 is purposely removed by specially designing the primary door 200.

Figure 6:
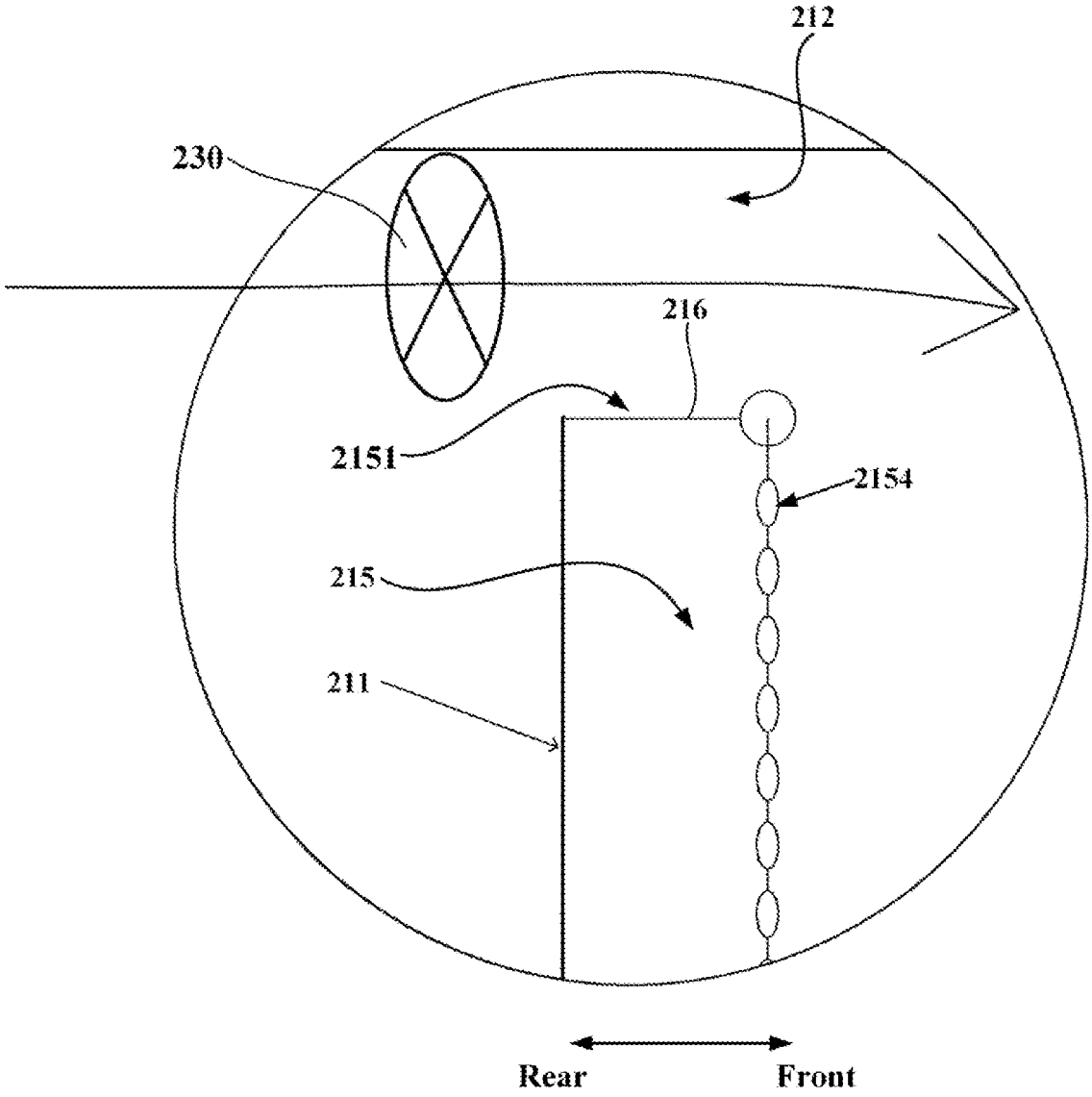
FIG. 6 is an enlarged view at A of FIG. 5.
Figure 7:
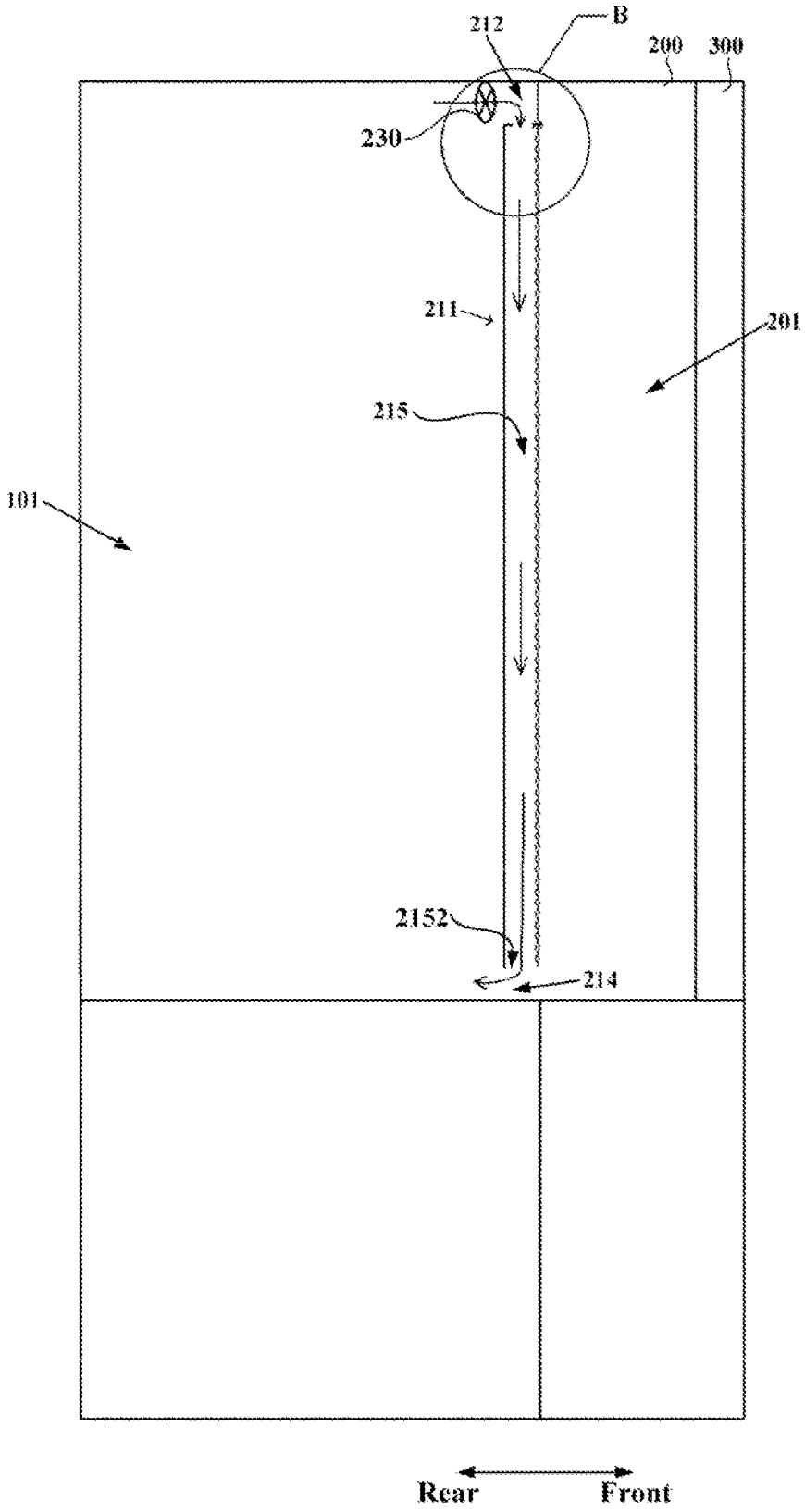
FIG. 7 is a schematic state diagram of the refrigerator shown in FIG. 5 in a condensation removing mode.

FIG. 6 is an enlarged view at A of FIG. 5; FIG. 7 is a schematic state diagram of the refrigerator shown in FIG. 5 in a condensation removing mode; and FIG. 8 is an enlarged view at B of FIG. 7.

Figure 8:
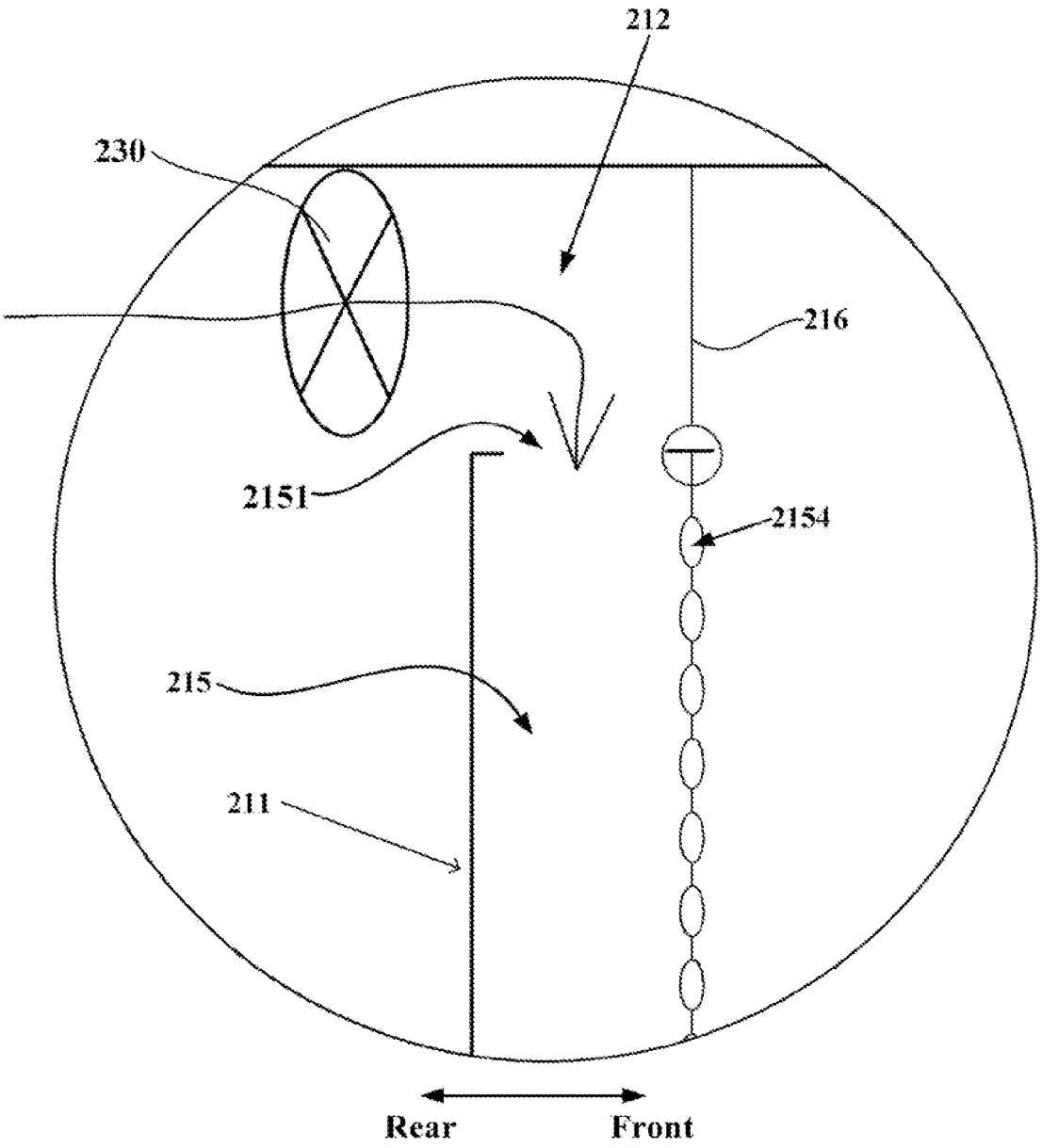
FIG. 8 is an enlarged view at B of FIG. 7.

As shown in FIGS. 5 to 8, the rear wall 211 of the primary door 200 is provided with an air supply port 212 and a return air port 214 which are communicated with the first compartment 101 and the second compartment 201. The rear wall 211 of the primary door 200 is hollow, and a condensation removing air duct 215 communicated with the first compartment 101 is defined in the rear wall. That is, the hollow space of the rear wall 211 forms the condensation removing air duct 215. A plurality of condensation removing holes 2154 communicated with the second compartment 201 and the condensation removing air duct 215 are formed in the front surface of the rear wall 211 backwards. The refrigerator is configured to: be in a cooling cycle mode where air in the first compartment 101 enters the second compartment 201 through the air supply port 212 and then returns to the first compartment 101 through the return air port 214, so as to refrigerate the second compartment 201 using the cold air of the first compartment 101, as shown in FIGS. 5 and 6. Or, the refrigerator is in a condensation removing mode where the air in the first compartment 101 enters the condensation removing air duct 215 to allow part of the air flow to flow to the front surface of the rear wall 211 through the condensation removing holes 2154, so as to remove surface condensation thereof, as shown in FIGS. 7 and 8.

In the embodiment of the present invention, the refrigerator is in the cooling cycle mode in a normal state. However, when more condensation occurs on the front surface of the rear wall 211 of the primary door 200 after humid air is introduced by door opening and closing operations or a high-humidity storage object is placed, the refrigerator may be controlled to operate in the above-described condensation removing mode, such that the air in the first compartment 101 enters the condensation removing air duct 215 inside the rear wall 211 of the primary door 200, so as to allow part of the air flow to flow to the front surface of the rear wall 211 through the condensation removing holes 2154. Since the relative humidity of the air in the condensation removing air duct 215 is certainly lower than that of the original air flow at the front surface of the rear wall 211 of the primary door 200 (the relative humidity of the air near the condensation is certainly high), and therefore, introduction of the low-humidity air in the condensation removing air duct 215 can promote evaporation of the condensation to complete the condensation removing process. When condensation removal is completed, the refrigerator can be controlled to be switched to the cooling cycle mode.

The switching time of the cooling cycle mode and the condensation removing mode can be automatically controlled by the refrigerator, such as timing switching or automatic switching of the refrigerator operation mode according to a detection result of a humidity sensor. The switching can also be controlled manually; for example, the refrigerator operation mode can be switched manually when the user finds that condensation removal is required or needs to be stopped.

When the refrigerator according to the embodiment of the present invention operates in the condensation removing mode, the traditional modes of electrically heating the rear wall 211 or introducing hot air, or the like, are not adopted, and condensation removal is carried out still utilizing the cold air of the first compartment 101, such that the normal refrigeration of the second compartment 201 is basically not influenced in the condensation removing process, and the structural design is ingenious.

In some embodiments, as shown in FIGS. 5 and 7, the condensation removing air duct 215 may have an inlet 2151 and an outlet 2152 communicated with the first compartment 101, so as to form air path circulation between the condensation removing air duct 215 and the first compartment 101 to avoid that the air flow for condensation removal is accumulated near the condensation removing air duct 215 and the condensation removing holes 2154, cannot circulate, and thus affects the condensation removing effect. Furthermore, the refrigerator is further configured to allow the inlet 2151 and the outlet 2152 to be in a closed state and an open state respectively when in the cooling cycle mode, and to allow both the inlet 2151 and the outlet 2152 to be in the open state when in the condensation removing mode. That is, only the inlet 2151 of the condensation removing air duct 215 is required to be closed in the cooling cycle mode. In the condensation removing mode, the inlet 2151 of the condensation removing air duct 215 is opened. Since opening and closing of the condensation removing air duct 215 are controlled by controlling opening and closing of the inlet 2151 and the outlet 2152 of the condensation removing air duct 215, the outlet 2152 of the condensation removing air duct 215 is not required to be controlled. In the two modes, the outlet 2152 of the condensation removing air duct 215 is in a normally open state and is not required to be controlled, so as to simplify the structure and control of the refrigerator.

In some embodiments, as shown in FIGS. 5 and 7, the inlet 2151 of the condensation removing air duct 215 may penetrate through the sidewall of the air supply port 212 to be communicated with the air supply port 212. That is, the condensation removing air duct 215 is communicated with the first compartment 101 through the air supply port 212, and no additional opening is required to be formed in the rear wall 211. The outlet 2152 of the condensation removing air duct 215 may also penetrate through the sidewall of the return air port 214 to be communicated with the return air port 214. That is, the condensation removing air duct 215 is communicated with the first compartment 101 through the return air port 214, and no additional opening is required to be formed in the rear wall 211. Such a design structure is quite ingenious, the opening structure of the rear wall 211 of the primary door 200 is simplified, and the rear surface of the rear wall 211 of the primary door 200 is only required to be directly provided with the air supply port 212 and the return air port 214.

In some embodiments, as shown in FIGS. 5 and 7, the air supply port 212 and the return air port 214 are located at the top and bottom of the rear wall 211 respectively. When the refrigerator is in the cooling cycle mode, after the cold air flows into the second compartment 201 from the air supply port 212, the cold air flows downwards to sequentially refrigerate regions at height levels of the second compartment 201 due to a sinking effect caused by relatively high density of the cold air, and after the temperature of the air is gradually increased, the air flows back to the first compartment 101 from the return air port 214 at the bottom of the second compartment 201. Thus, smoother air path circulation is formed to improve the refrigerating effect of the second compartment 201. When the refrigerator is in the condensation removing mode, the cold air enters the condensation removing air duct 215 from the top of the condensation removing air duct 215, and can better flow downwards, such that the condensation removing air duct 215 has a better circulation performance which is favorable for accelerating the condensation removing process.

As shown in FIGS. 6 and 8, the refrigerator may further include a damper 216 mounted at the air supply port 212 and configured to be controllably moved to a cooling state (like FIG. 6) where the inlet 2151 is closed and the air supply port 212 is opened, or to a condensation removing state (like FIG. 8) where the inlet 2151 is opened and the air supply port 212 is closed. In the present embodiment, the advantage that the inlet 2151 is communicated with the air supply port 212 is effectively utilized, and one damper 216 is used to simultaneously control the air supply port 212 and the inlet 2151, thereby simplifying the air inlet and outlet control and having an ingenious design.

Specifically, as shown in FIGS. 6 and 8, one end of the damper 216 may be rotatably mounted at the front edge of the inlet 2151 to rotate to the cooling state (like FIG. 6) or the condensation removing state (like FIG. 8). In the embodiment of the present invention, the switching of the refrigerator operation mode can be completed by controlling the rotation of one damper 216 without providing a complex motion mechanism and control logic, and the structure and control are greatly simplified.

In some embodiments, as shown in FIGS. 5 to 8, the refrigerator further includes a fan 230, and the fan 230 is located at the air supply port 212 and used for forcing the air of the first compartment 101 to flow to the air supply port 212 to increase a cooling circulation speed. Certainly, for the solution where the inlet 2151 is communicated with the air supply port 212, the fan 230 is also used to force the air in the first compartment 101 to flow to the condensation removing air duct 215.

The inventor recognizes that the closer to the air supply port 212, the more the condensation generated on the rear wall 211 of the primary door 200, and the closer to the return air port 214, the less the condensation. To this end, in the embodiment of the present invention, the arrangement density of the condensation removing holes 2154 is specially designed, such that the arrangement density of the condensation removing holes 2154 is gradually decreased in a direction from the air supply port 212 to the return air port 214 to be matched with the variation tendency of the condensation degree at different positions of the rear wall 211 of the primary door 200, thereby reducing excessive meaningless openings. The opening region of the rear wall 211 of the primary door 200 may be spread over the entire front surface of the rear wall 211 to realize sufficient condensation removal, or may be spread over a part of the front surface of the rear wall 211. The percentage of opening of the condensation removing holes 2154 can be 30% to 80%. The condensation removing holes 2154 may be arranged in a matrix or other forms. The condensation removing holes 2154 may have circular, oval, square, or other shapes. Preferably, the condensation removing holes 2154 are long-strip shaped holes with the length direction parallel to the air flow direction of the condensation removing air duct 215, and such a structure is favorable for destroying the integrity of condensation and accelerating dispersion and evaporation of the condensation.

So far, those skilled in the art should be aware that, although plural exemplary embodiments of the present invention have been shown and described herein in detail, a lot of other variations or modifications conforming to the principle of the present invention can still be directly determined or derived from the contents disclosed in the present invention without departing from the spirit and scope of the present invention. Therefore, the scope of the present invention should be understood and deemed as covering all of these other variations or modifications.

What is claimed is:

1. A refrigerator, comprising:

a refrigerator body having an open front side to define a first compartment;

a primary door mounted to the refrigerator body and used for opening/closing the first compartment, the primary door defining a second compartment having an open front side, the second compartment being formed in the primary door; and a secondary door mounted to the primary door and used for opening/closing the second compartment, the secondary door comprising a state adjustable door panel, and the state adjustable door panel being configured to controllably change transparency such that the visibility of an internal structure of the second compartment is adjustable;

wherein a rear wall of the primary door is provided with an air supply port and a return air port which are communicated with the first compartment and the second compartment;

wherein the rear wall is hollow;

wherein a condensation removing air duct communicated with the first compartment is defined in the rear wall, wherein a plurality of condensation removing holes directly communicated with the second compartment and the condensation removing air duct and directly facing the second compartment are formed in a front surface of the rear wall; and wherein the refrigerator is configured to be:

in a cooling cycle mode where air in the first compartment enters the second compartment through the air supply port and then returns to the first compartment through the return air port, or in a condensation removing mode where the air in the first compartment enters the condensation removing air duct, and then part of an air flow is allowed to flow from the condensation removing air duct to the front surface of the rear wall and the second compartment through the condensation removing holes to remove surface condensation of the rear wall.

2. The refrigerator according to claim 1, wherein the state adjustable door panel is configured to be in a transparent state when a human body exists within a preset distance from the front side of the secondary door, and in a non-transparent state when no human body exists in the preset distance from the front side of the secondary door.

3. The refrigerator according to claim 1, wherein the second compartment is divided into a plurality of storage regions;

wherein the state adjustable door panel comprises a plurality of adjusting subregions with independently adjustable transparency, and the adjusting subregions are opposite to the plurality of storage regions respectively; and wherein the state adjustable door panel is configured to switch each adjusting subregion from the non-transparent state to the transparent state when the adjusting subregion is pressed, such that the corresponding storage region is in a visible state.

4. The refrigerator according to claim 1, wherein the state adjustable door panel comprises a first glass layer, a second glass layer, and a liquid crystal layer therebetween, and the liquid crystal layer is configured to be in a transparent state when in a powered-on state and in a non-transparent state when in a powered-off state.

5. The refrigerator according to claim 1, wherein the condensation removing air duct has an inlet and an outlet communicated with the first compartment; and wherein the refrigerator is configured to allow the inlet and the outlet to be in a closed state and an open state respectively when in the cooling cycle mode, and to allow both the inlet and the outlet to be in the open state when in the condensation removing mode.

6. The refrigerator according to claim 5, wherein the inlet penetrates through a sidewall of the air supply port to be communicated with the air supply port, and the outlet penetrates through a sidewall of the return air port to be communicated with the return air port.

7. The refrigerator according to claim 6, further comprising:

a damper mounted at the air supply port and configured to be controllably moved to a cooling state where the inlet is closed and the air supply port is opened, or to a condensation removing state where the inlet is opened and the air supply port is closed.

8. The refrigerator according to claim 7, wherein one end of the damper is rotatably mounted at a front edge of the inlet to rotate to the cooling state or the condensation removing state.

9. The refrigerator according to claim 1, wherein the arrangement density of the condensation removing holes is gradually decreased in a direction from the air supply port to the return air port.

10. The refrigerator according to claim 1, wherein the condensation removing air duct is formed between the front surface and a rear surface of the rear wall of the primary door and extends vertically to run through the rear wall in an up and down direction.

* * * * *